US012618558B2

(12) United States Patent
Sharma

(10) Patent No.: US 12,618,558 B2
(45) Date of Patent: May 5, 2026

(54) METHODS FOR OPERATING A HEATING DEVICE

(71) Applicant: SABIC GLOBAL TECHNOLOGIES B.V., Bergen Op Zoom (NL)

(72) Inventor: Ananth Sharma, Bangalore (IN)

(73) Assignee: SABIC GLOBAL TECHNOLOGIES B.V., Bergen op Zoom (NL)

( * ) Notice: Subject to any disclaimer, the term of this patent is extended or adjusted under 35 U.S.C. 154(b) by 417 days.

(21) Appl. No.: 18/258,724

(22) PCT Filed: Nov. 18, 2021

(86) PCT No.: PCT/IB2021/060712

§ 371 (c)(1),
(2) Date: Jun. 21, 2023

(87) PCT Pub. No.: WO2022/136970

PCT Pub. Date: Jun. 30, 2022

(65) Prior Publication Data

US 2024/0271783 A1 Aug. 15, 2024

Related U.S. Application Data

(60) Provisional application No. 63/128,793, filed on Dec. 21, 2020.

(51) Int. Cl.

| | |
|---|---|
| ***F23L 7/00*** | (2006.01) |
| ***F23C 7/00*** | (2006.01) |
| ***F23D 14/32*** | (2006.01) |

(52) U.S. Cl.

CPC ..... *F23L 7/007* (2013.01); *F23C 7/00* (2013.01); *F23D 14/32* (2013.01); *F23L 2900/07005* (2013.01); *F23L 2900/07007* (2013.01)

(58) Field of Classification Search

None

See application file for complete search history.

(56) References Cited

U.S. PATENT DOCUMENTS 4,537,606 A * 8/1985 Itoh ..... B01D 53/22 96/417
4,553,988 A * 11/1985 Shimizu ..... F27D 99/0001 96/7

(Continued)

FOREIGN PATENT DOCUMENTS

| | | |
|---|---|---|
| CN | 101336128 | 12/2008 |
| WO | WO 01/35024 | 5/2001 |

(Continued)

OTHER PUBLICATIONS

Fu et al. "Modelling of the oxy-combustion fluid catalytic cracking units", *Com[uter Aided Chemicla Engineering*, vol. 40, pp. 331-336, 2017.

(Continued)

*Primary Examiner* — Jorge A Pereiro

(74) *Attorney, Agent, or Firm* — Norton Rose Fulbright US LLP

(57) ABSTRACT

Systems and methods for operating a heating device are disclosed. An oxygen containing stream is first processed to produce an oxygen stream that comprises more than 25 vol. % oxygen. The oxygen stream is then mixed with an air stream to produce a combustion gas stream comprising 21.5 to 27 vol. % oxygen. A fuel is combusted in the combustion gas stream to provide heat for a heating device.

8 Claims, 4 Drawing Sheets

(56) References Cited

U.S. PATENT DOCUMENTS

| | | | | |
|---|---|---|---|---|
| 5,865,878 | A | 2/1999 | Drnevich et al. | |
| 6,149,714 | A | 11/2000 | Kobayashi | |
| 6,394,043 | B1 | 5/2002 | Bool et al. | |
| 6,562,104 | B2 | 5/2003 | Bool | |
| 6,568,185 | B1 * | 5/2003 | Marin | F25J 3/04018 60/671 |
| 6,935,251 | B2 * | 8/2005 | Marin | F23G 5/50 110/204 |
| 10,107,192 | B2 | 10/2018 | Nemitallah et al. | |
| 2002/0073844 | A1 | 6/2002 | Bool et al. | |
| 2002/0073938 | A1 | 6/2002 | Bool et al. | |
| 2002/0124558 | A1 | 9/2002 | Griffin et al. | |
| 2004/0002030 | A1 * | 1/2004 | Shah | F23L 7/007 431/12 |
| 2007/0134604 | A1 * | 6/2007 | Sirman | F23L 7/007 431/2 |
| 2007/0295250 | A1 * | 12/2007 | Bool | F23G 7/00 110/342 |
| 2012/0129110 | A1 * | 5/2012 | Siljan | C01B 13/0251 431/190 |
| 2013/0200625 | A1 * | 8/2013 | Wei | F23C 9/00 290/52 |
| 2014/0004470 | A1 * | 1/2014 | Huang | F23L 15/00 110/301 |
| 2014/0174329 | A1 * | 6/2014 | Nemitallah | F23L 7/007 110/190 |
| 2015/0098880 | A1 | 4/2015 | Kelly | |
| 2017/0284661 | A1 * | 10/2017 | Ben-Mansour | F23D 5/00 |

FOREIGN PATENT DOCUMENTS

| | | |
|---|---|---|
| WO | WO 2009/144366 | 12/2009 |
| WO | WO 2012096940 | 7/2012 |

OTHER PUBLICATIONS

Habib et al. "Numerical investigation of syngas oxy-combustion inside LSCF-6428 oxygen transport membrane reactor", *Energy,* vol. 96, pp. 65-665, 2016.

International Search Report and Written Opinion issued in corresponding International Patent Application PCT/IB2021/060712 mailed Feb. 14, 2022.

Kiriishi et al., "High Efficiency furnace with oxy-fuel combustion and zero-emission by CO2 Recovery", *Industrial Technology Sect. Industrial Gas Sales Dept,* 2013.

Lambert et al. "Analysis of oxygen-enriched combustions for steam methane reforming (SMR)", *Energy,* vol. 22, Iss. 8, pp. 817-825, 1997.

Lin, "Membrane-based oxygen enriched combustion", *Ind. Eng. Chem. Res.* vol. 52, No. 31, pp. 10820-10834, 2013.

Portillo et al. "Alternatives for oxygen-selective membrane systems and their integration into the oxy-fuel combustion process: A review", *Separation and Purification Technology*, vol. 229, 2019.

Scheffknecht et al. "Oxy-fuel coal combustion—A review of the current state-of-the-art", *International Journal of Greenhouse Gas Control*, vol. 5, Supp. 1, pp. s16-s35, 2011.

Weikl et al. "Carbon Capture in Cracking Furnaces", *AIChE Paper No. 12c,* 2010.

*Energy Dictionary*, edited by Guangyan Zou, Sichuan Science and Technology Press, 1997, pp. 856-859 (English Machine Translation provided).

Office Action issued in corresponding Chinese Application No. 202180093074.2, dated Nov. 29, 2025 (English Translation provided).

* cited by examiner

METHODS FOR OPERATING A HEATING DEVICE

CROSS REFERENCE TO RELATED APPLICATIONS

This application is a national phase under 35 U.S.C. § 371 of International Application No. PCT/IB2021/060712, filed Nov. 18, 2021, which claims the benefit of priority to U.S. Provisional Patent Application No. 63/128,793, filed Dec. 21, 2020, the entire contents of each of which are hereby incorporated by reference in their entirety.

FIELD OF INVENTION

The present invention generally relates to systems and methods for operating heating devices. More specifically, the present invention relates to systems and methods for producing oxygen enriched combustion gas used for combusting fuels in heating devices.

BACKGROUND OF THE INVENTION

Heating is one of the most important processes in the chemical processing industry. Generally, to provide heat for chemical production processes, a fuel is combusted in air in a heating device (e.g., furnace, boiler, and heat exchanger). However, many chemical production processes, including steam cracking, are conducted at high operating temperatures, which requires the combustion process to be highly intense. The current methods of combusting fuel in air have limitations with respect to providing sufficient heat for chemical production processes, resulting in limited chemical production efficiency. Although the capacity of most heaters can be increased by simply firing hard, i.e., pushing in more fuel, the requirement for combustion air subsequently increases. The furnace can reach one or more of the following constraints including (1) mechanical flow limitation on process side like peak velocity; (2) limit of fuel gas header pressure; (3) limit of combustion air flow capacity. This results in furnace becoming the limiting equipment in further increasing the plant capacity. Various options can be explored to address the furnace capacity limitation, which may include installing a new furnace, upgrading design of furnace, burners or a combination, use of oxy-fuel combustion, etc. However, all these options are highly capital intensive and may be cost inhibitive. For pure $O_2$ combustion, the main challenge includes availability and cost of $O_2$ and furnace and burner modifications costs. An alternative in cases where small or moderate levels of production increase is desired is to use $O_2$ enriched combustion instead of pure $O_2$ combustion.

Overall, while the methods of operating a heating device exist, the need for improvements in this field persists in light of the aforementioned drawback with conventional methods.

BRIEF SUMMARY OF THE INVENTION

A solution to at least the above-mentioned problem associated with the methods of operating a heating device has been discovered. The solution resides in a method of operating a heating device comprising using membrane based separation modules to produce an oxygen enriched air (>21 vol. % $O_2$) as a combustion gas and combusting a fuel in the combustion gas. This can be beneficial for at least increasing energy efficiency for the fuel compared to conventional methods. Additionally, the disclosed method can further include flowing a first air stream through a membrane module and flowing a second air stream counter-currently to the first air stream through a separate air inlet to generate a countercurrent sweep of air across a permeate side of the membrane module, thereby improving energy efficiency of the membrane separation process. Furthermore, the disclosed method can include using a membrane separation unit installed at the inlet of the heating device, thereby eliminating the capital expenditure for exhaust fan, air blower, and ducting work. Furthermore, the disclosed method may include injecting oxygen enriched air upstream of the heating device (e.g., steam cracking furnace) via diffusors, resulting in improved mixing efficiency of oxygen and the fuel, compared to conventional methods. Therefore, the disclosed systems and methods of the present invention provide a technical solution to the problem associated with the conventional systems and methods for operating a heating device.

Embodiments of the invention include a method of operating a heating device. The method comprises flowing a first stream comprising oxygen through one or more oxygen separation membrane modules at a first inlet of the heating device to produce an oxygen enriched stream. The method comprises flowing a second stream comprising and the oxygen stream into the heating device counter-currently to each other such that the second stream mixes with the oxygen stream to produce an oxygen enriched combustion gas stream. The method further still comprises combusting a fuel in the oxygen enriched combustion gas stream in the heating device to produce heat.

Embodiments of the invention include a method of operating a heating device. The method comprises flowing a first air stream through one or more oxygen separation membrane modules disposed at a first inlet of the heating device to produce an oxygen enriched air stream. The method comprises flowing a second air stream and the oxygen stream into the heating device counter-currently to each other such that a countercurrent sweep of air across a permeate side of the oxygen separation membrane modules is generated and the second air stream mixes with the oxygen stream to produce an oxygen enriched combustion gas stream comprising 21.5 to 27 vol. % $O_2$. The method further comprises combusting a fuel in the oxygen enriched combustion gas stream in the heating device to produce heat.

Embodiments of the invention include a method of operating a heating device. The method comprises flowing a stream comprising oxygen through one or more membrane based oxygen separation modules to produce an oxygen enriched stream. The method comprises mixing the oxygen stream with a gas stream to form a combustion gas stream comprising more than 21 wt. % oxygen. The method comprises injecting the combustion gas stream via one or more diffusers upstream to an air inlet of the heating device such that the combustion gas stream is mixed with a fuel. The method further comprises combusting, in the heating device, the fuel in the combustion gas to produce heat.

The following includes definitions of various terms and phrases used throughout this specification.

The terms "about" or "approximately" are defined as being close to as understood by one of ordinary skill in the art. In one non-limiting embodiment the terms are defined to be within 10%, preferably, within 5%, more preferably, within 1%, and most preferably, within 0.5%.

The terms "wt. %", "vol. %" or "mol. %" refer to a weight, volume, or molar percentage of a component, respectively, based on the total weight, the total volume, or the total moles of material that includes the component. In a non-limiting example, 10 moles of component in 100 moles of the material is 10 mol. % of component.

The term "substantially" and its variations are defined to include ranges within 10%, within 5%, within 1%, or within 0.5%.

The terms "inhibiting" or "reducing" or "preventing" or "avoiding" or any variation of these terms, when used in the claims and/or the specification, include any measurable decrease or complete inhibition to achieve a desired result.

The term "effective," as that term is used in the specification and/or claims, means adequate to accomplish a desired, expected, or intended result.

The use of the words "a" or "an" when used in conjunction with the term "comprising," "including," "containing," or "having" in the claims or the specification may mean "one," but it is also consistent with the meaning of "one or more," "at least one," and "one or more than one."

The words "comprising" (and any form of comprising, such as "comprise" and "comprises"), "having" (and any form of having, such as "have" and "has"), "including" (and any form of including, such as "includes" and "include") or "containing" (and any form of containing, such as "contains" and "contain") are inclusive or open-ended and do not exclude additional, unrecited elements or method steps.

The process of the present invention can "comprise," "consist essentially of," or "consist of" particular ingredients, components, compositions, etc., disclosed throughout the specification.

The term "primarily," as that term is used in the specification and/or claims, means greater than any of 50 wt. %, 50 mol. %, and 50 vol. %. For example, "primarily" may include 50.1 wt. % to 100 wt. % and all values and ranges there between, 50.1 mol. % to 100 mol. % and all values and ranges there between, or 50.1 vol. % to 100 vol. % and all values and ranges there between.

Other objects, features and advantages of the present invention will become apparent from the following figures, detailed description, and examples. It should be understood, however, that the figures, detailed description, and examples, while indicating specific embodiments of the invention, are given by way of illustration only and are not meant to be limiting. Additionally, it is contemplated that changes and modifications within the spirit and scope of the invention will become apparent to those skilled in the art from this detailed description. In further embodiments, features from specific embodiments may be combined with features from other embodiments. For example, features from one embodiment may be combined with features from any of the other embodiments. In further embodiments, additional features may be added to the specific embodiments described herein.

BRIEF DESCRIPTION OF THE DRAWINGS

For a more complete understanding, reference is now made to the following descriptions taken in conjunction with the accompanying drawings, in which:

FIG. 1A shows a schematic of a system for operating a heating device including a membrane separation module at an inlet of a heating device; FIG. 1B shows a schematic of a system for operating a heating device including a plurality of membrane separation modules in parallel; FIG. 1C shows schematic of a diffusor that can be used in the system depicted in FIG. 1B; FIG. 1D shows a burner of a heating device with optimal inlets for oxygen enriched gas, according to embodiments of the invention;

FIG. 3A shows a schematic diagram of an induced draft for a heating device; FIG. 3B shows a schematic of balanced draft for a heating device.

DETAILED DESCRIPTION OF THE INVENTION

Currently, a fuel and air mixture is combusted to provide heat to heating devices, which in turn are used to provide heat to production processes. However, the heating efficiency and/or fuel efficiency for conventional methods are relatively limited. Combusting fuels in pure oxygen may increase the fuel efficiency due to higher flame temperatures. However, retrofitting existing air combustion furnaces with pure oxygen requires a large amount of capital expenditure. For example, most furnaces in ethylene service are natural or induced draft. These need to be converted to forced or balanced draft with flue gas re-circulation for operating under pure oxygen combustion. Burner configuration also needs to change with pure oxygen. Optimally designed pure oxygen combustion with flue gas re-circulation can minimize changes required to burners as well as convection section, but this is usually used as an opportunity for $CO_2$ capture. The present invention provides a solution to at least some of these problems. The solution is premised on a method of providing heat to a heating device including using membrane based separation modules to produce oxygen enriched combustion gas ($O_2$ vol. %>21 vol. %), resulting in higher fuel efficiency. Furthermore, the disclosed method does not drastically reduce the production of flue gas, mitigating heat distribution issues of combustion in pure oxygen. Additionally, the disclosed method is capable of generating countercurrent sweep at the permeate side of the membrane module, thereby reducing energy consumption for membrane based oxygen separation. These and other non-limiting aspects of the present invention are discussed in further detail in the following sections.

A. System for Operating Heating Device

Figure 1A:
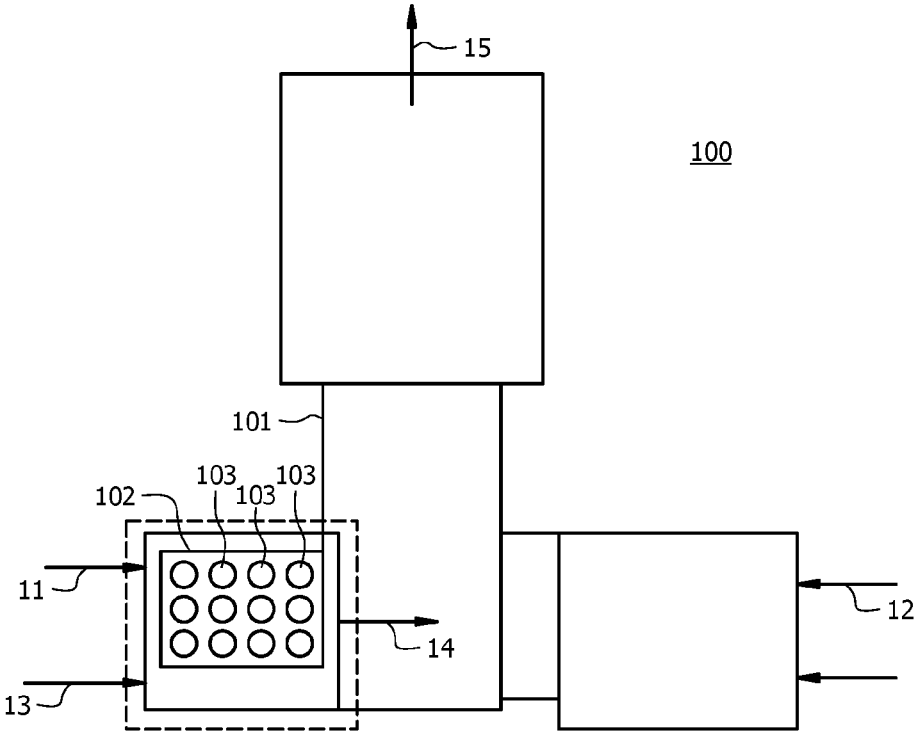
FIGS. 1A to 1D show schematics of systems for operating a heating device, according to embodiments of the invention.

In embodiments of the invention, the system for providing heat to a heating device uses oxygen enriched gas ($O_2$ vol. %>21 vol. %) for higher fuel efficiency. Notably, the method is capable of producing sufficient flue gas to maintain heat distribution in the heating device while maintaining a higher combustion efficiency than conventional methods. With reference to FIG. 1A, a schematic diagram is shown for system 100, which is used for providing heat to a heating device.

According to embodiments of the invention, the heating device can include a furnace, a boiler, a vacuum distillation unit heater, a crude distillation unit heater, a sulfuric acid regeneration heater, or combinations thereof. In embodiments of the invention, system 100 comprises first heating device 101 configured to combust a fuel in a combustion gas therein. First heating device 101 can include a boiler or a furnace that includes one or more burners. The furnace can be a furnace of a conventional steam cracking unit.

In embodiments of the invention, system 100 further includes membrane separation unit 102 configured to separate oxygen from first stream 11 to produce a gas comprising 28 to 35 wt. % oxygen. First stream 11 can include air. According to embodiments of the invention, membrane separation unit 102 can comprise a plurality of membrane separation modules 103. Membrane separation modules 103 may include ceramic based membranes, polymer based membranes, metal complexes enhanced membranes, or combinations thereof. Membrane separation modules 103 may include a compressor module, a turbo expander module, membrane modules in series (i.e., in stack configuration), a filter module.

According to embodiments of the invention, membrane separation unit 102 can include an additional entry configured to receive additional stream 13 therein such that oxygen separated from first stream 11 mixes with additional stream 13 to form first combustion gas stream 14. First combustion gas stream 14 may include more than 21 vol. % oxygen, preferably 25 to 35 vol. % oxygen. Additional stream 13, in embodiments of the invention, can include air. In embodiments of the invention, membrane separation unit 102 is installed at a first inlet of a burner of heating device 101.

Figure 3A:
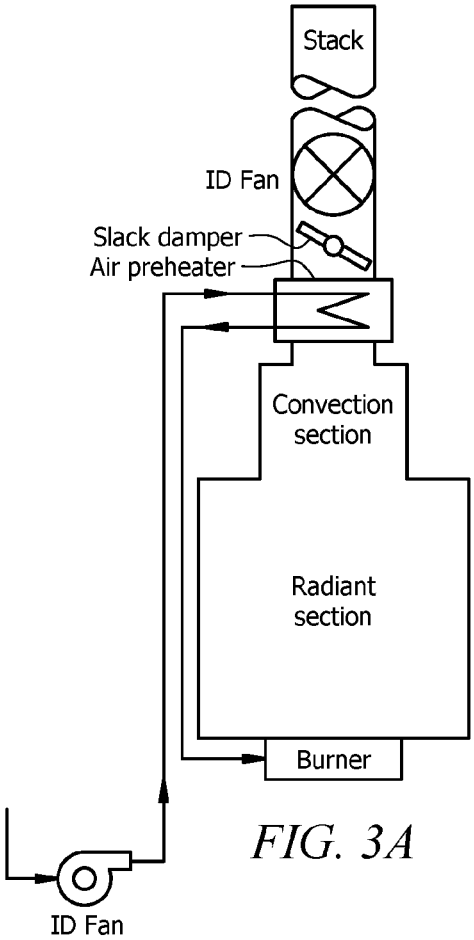
FIGS. 3A and 3B show schematic diagrams of various draft scheme for a heating device, according to embodiments of the invention.
Figure 3B:
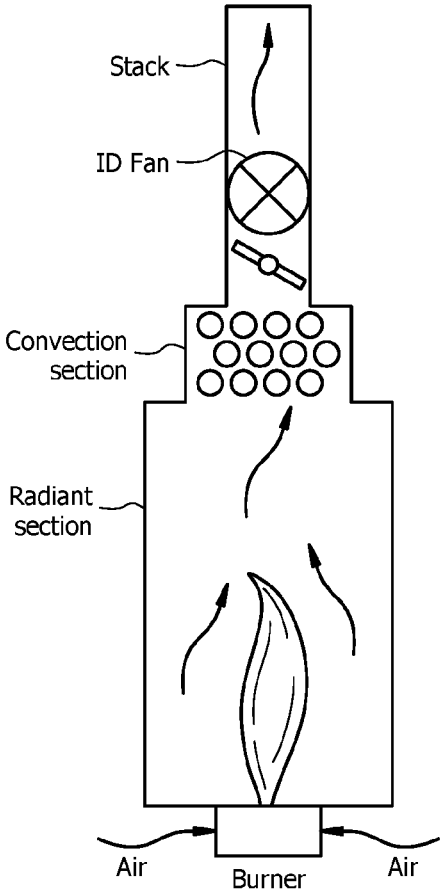

According to embodiments of the invention, the burner of heating device 101 includes a second inlet configured to receive second stream 12 into the burner. The second inlet is configured such that second stream 12 and first stream 11 are flowed into the burner counter-currently to generate counter-current sweep of air across permeate side of the membrane separation module(s) 103. In embodiments of the invention, the counter-current sweep is capable of reducing energy consumption of oxygen separation in membrane separation unit 102. In embodiments of the invention, oxygen generated by membrane separation unit 102 or first combustion gas stream 14 is combined with second stream 12 to form oxygen enriched combustion gas stream 15. Second stream 12 may include air. Oxygen enriched combustion gas stream 15 can include 21.5 to 27 vol. % oxygen. Heating device 101 can be operated with induced draft and/or natural draft. Balanced. In embodiments of the invention, forced draft is generated by placing an exhaust fan at the base of a heater (e.g., heating device 101), which causes overpressure to drive air into the heater through burner air inlets. Balanced draft, as shown in FIG. 3A, is generated by adjusting forced draft and induced draft to achieve atmospheric pressure in the burner to avoid inadvertent additional air flowing into the heating device. Induced draft, as shown in FIG. 3B, is generated by pulling air through a heater (e.g., heating device 101) using an axial fan placed on top of the heater. Induced draft is configured to create low pressure in the heater, which pulls air through burner air inlets of the heater.

Figure 1B:
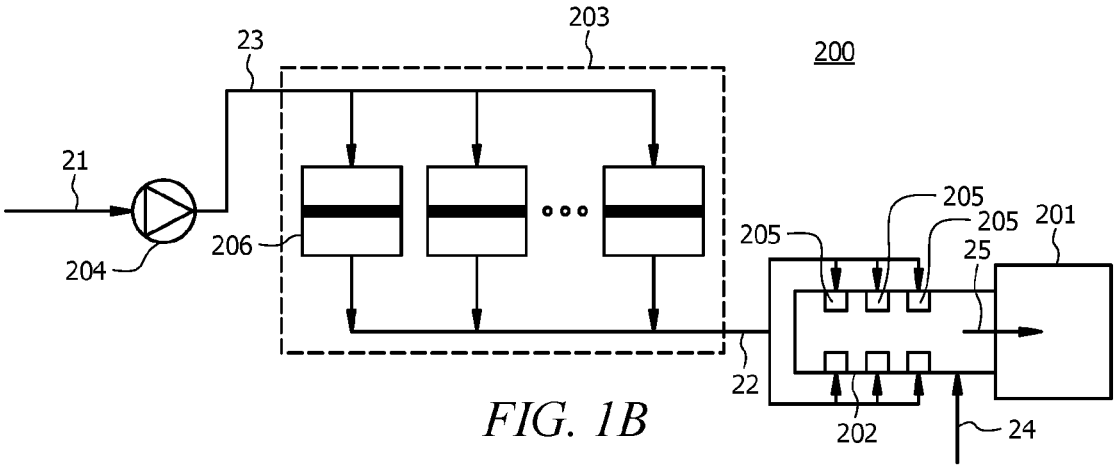

With reference to FIG. 1B, a schematic diagram is shown for system 200, which is used for providing heat to a heating device. According to embodiments of the invention, system 200 includes second heating device 201. Second heating device 201 can include a boiler, a furnace, a reboiler, a heat exchanger, or combinations thereof. In embodiments of the invention, system 200 comprises compressor 204 configured to compress first oxygen containing stream 21 to form compressed oxygen containing stream 23. First oxygen containing stream 21 may comprise air.

According to embodiments of the invention, an outlet of compressor 204 may be in fluid communication with an inlet of second membrane separation unit 203 such that compressed oxygen containing stream flows from compressor 204 to second membrane separation unit 203. Second membrane separation unit 203 may include one or more second membrane modules 206 operated in parallel Second membrane modules 206 can include ceramic based membranes, polymer based membranes, metal complexes enhanced membranes, or combinations thereof. Second membrane modules 206 of second membrane separation unit 203 can include a compressor, a turbo expander, membrane modules in series (e.g., in stack configuration), various types of filters. Second membrane separation unit 203 can be configured to process compressed oxygen containing stream 23 to produce second oxygen enriched stream 22. Second oxygen enriched stream 22 may include 25 to 30 vol. % oxygen. As an alternative to or in addition to separating compressed oxygen containing stream 23, second membrane separation unit 203 may be configured to process oxygen containing stream 21 to produce second oxygen enriched stream 22.

Figure 1C:
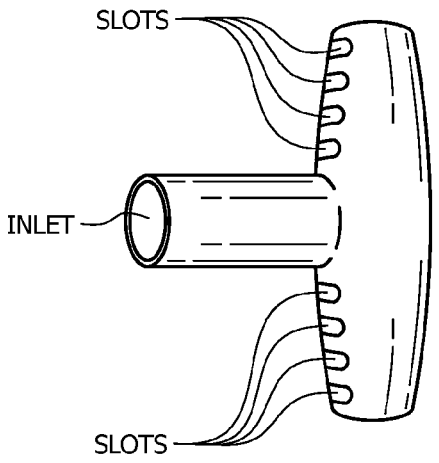

According to embodiments of the invention, an outlet of membrane separation unit 203 is in fluid communication with central duct 202. Membrane modules centrally located are configured for forced or balanced draft furnaces. The membrane module of membrane separation unit 203 can be located close to an air blower that is configured to provide combustion air to furnaces. Diffusers 305 are configured to inject second oxygen enriched stream 22 (25-35 wt. % oxygen) into central combustion air duct such that second oxygen enriched stream 22 flows from membrane separation unit 203 to central duct 202. Each of diffusers 205, as shown in FIG. 1C, may include a plurality of slots for releasing gas. Diffusers 205 is further configured to mix second oxygen enriched stream 22 with second air stream 24 comprising air in central duct 202 to form third combustion gas stream 25. Third combustion gas stream 25 can include 21.5 to 27 vol. % oxygen.

According to embodiments of the invention, central duct 202 is attached to second heating device 201 such that second oxygen enriched stream 22 released in central duct work 202 flows into one or more burners of second heating device 201. Second heating device 201 may include a furnace of a steam cracker, a furnace of a steam reformer, a boiler, a vacuum distillation unit heater, a crude distillation unit heater, a sulfuric acid regeneration heater, or combinations thereof. In embodiments of the invention, second heating device 201 can be operated with forced draft or balanced draft.

Figure 1D:
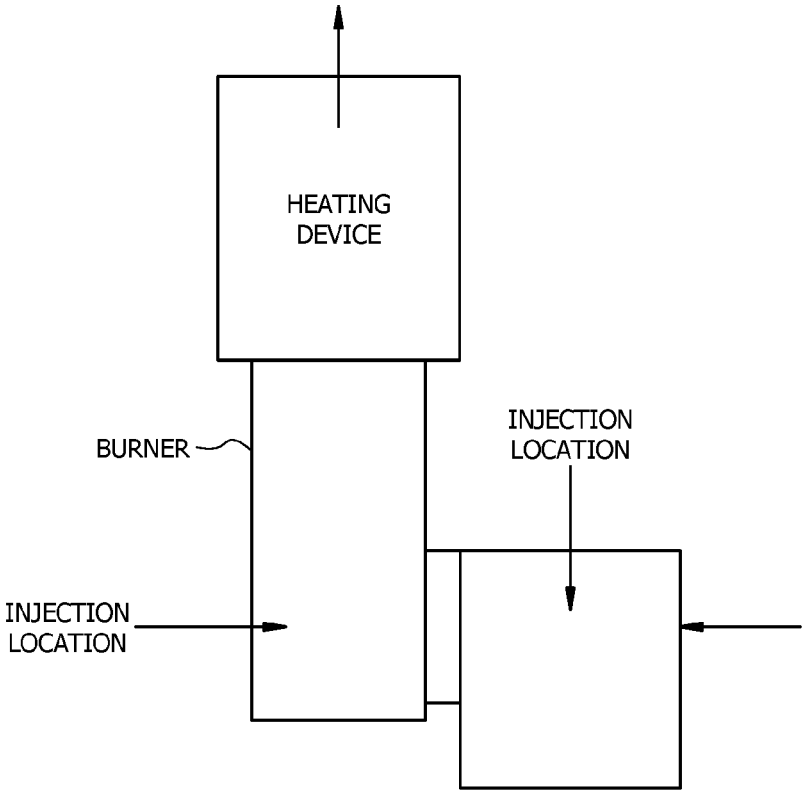

According to embodiments of the invention, for system 100 and/or system 200, oxygen enriched gas, including oxygen enriched air, can be produced in a central location and/or central equipment. The oxygen enriched gas produced in the central location and/or central equipment can be injected in a burner of a heating device at air plenum of the burner, and/or, as shown in FIG. 1D. The oxygen enriched gas can be injected to the burner via one or more diffusors.

B. Method of Operating Heating Device

Figure 2A:
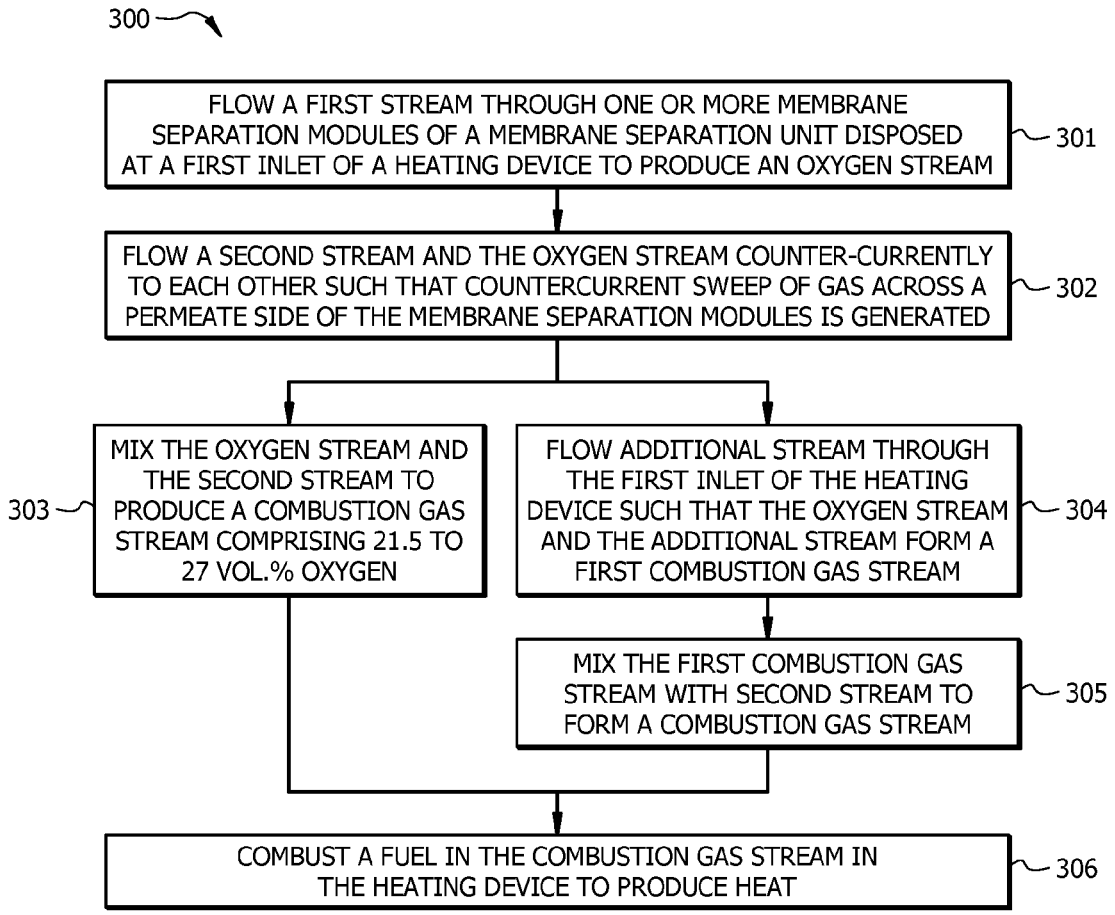
FIGS. 2A and 2B show schematic flow charts for methods of operating heating devices, according to embodiments of the invention.

A method of operating a heating device has been discovered. The method may be capable of increasing fuel combustion efficiency compared to conventional methods. As shown in FIG. 2A, embodiments of the invention include method 300 of operating a heating device. Method 300 may be implemented by system 100.

According to embodiments of the invention, as shown in block 301, method 300 includes flowing first stream 11 through one or more membrane separation modules 103 of membrane separation unit 102 disposed at a first inlet of heating device 101 to produce an oxygen stream. In embodiments of the invention, first stream 11 is an oxygen containing stream. The oxygen containing stream can include air. In embodiments of the invention, the oxygen stream produced from membrane separation unit 102 includes an oxygen content of 28 to 35 vol. %. In embodiments of the invention, at block 301, one or more membrane separation modules 103 are operated at an operating pressure in a range of 3 to 15 bar. One or more membrane separation modules 103 may be operated at an operating temperature of 10 to 50° C., preferably 25 to 30° C.

According to embodiments of the invention, as shown in block 302, method 300 includes flowing second stream 12 and the oxygen stream counter-currently to each other such that countercurrent sweep of gas across a permeate side of one or more membrane separation modules 103 is generated. In embodiments of the invention, the countercurrent sweep is configured to reduce energy consumption for separating oxygen from first stream 11 using one or more membrane separation modules 103. In embodiments of the invention, second stream 12 includes air. In embodiments of the invention, as shown in block 303, method 300 includes mixing the oxygen stream and second stream 12 to produce combustion gas stream 15. Combustion gas stream 15 may include oxygen enriched air comprising 21.5 to 27 vol. % oxygen. Blocks 302 and 303 may be conducted simultaneously.

As an alternative to, or in addition to, mixing the oxygen stream with second stream 12 to form combustion gas stream 15, as shown in block 304, method 300 may include flowing additional stream 13 through the first inlet of heating device 101 such that the oxygen stream and additional stream 13 form first combustion gas stream 14. Additional stream 13 may include air. In embodiments of the invention, first combustion gas stream 14 may include 25 to 30 vol. % oxygen. In embodiments of the invention, as shown in block 305, method 300 includes mixing first combustion gas stream 14 with second stream 12 to form combustion gas stream 15. Blocks 302 and 305 may be conducted simultaneously. Combustion gas stream 15 can be an oxygen enriched air stream comprising 21.5 to 27 vol. % oxygen.

According to embodiments of the invention, as shown in block 306, method 300 includes combusting a fuel in combustion gas stream 15 in heating device 101 to produce heat. In embodiments of the invention, exemplary fuel can include natural gas, ethane, propane, $CH_4$, or combinations thereof. In embodiments of the invention, method 300 is conducted without re-circulating flue gas. First heating device 101 can be operated with balanced draft and/or forced draft.

Figure 2B:
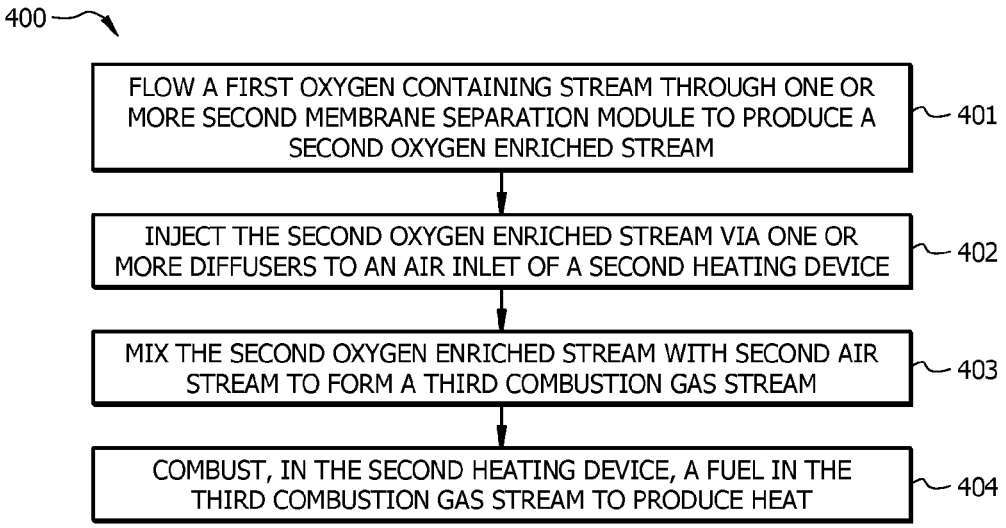

As shown in FIG. 2B, embodiments of the invention include method 400 of operating a heating device. Method 400 may be implemented by system 200. According to embodiments of the invention, as shown in block 401, method 400 includes flowing first oxygen containing stream 21 through one or more second membrane modules 206 to produce second oxygen enriched stream 22. Second oxygen enriched stream 22 may include 25 to 30 vol. % oxygen. In embodiments of the invention, an operating pressure of one or more second membrane modules 206 at block 401 is in a range of 3 to 15 bar. One or more second membrane modules 206 may be operated at an operating temperature of 10 to 50° C.

According to embodiments of the invention, as shown in block 402, method 400 includes injecting second oxygen enriched stream 22 at a location upstream to an air inlet of second heating device 201 via one or more diffusers 205. In embodiments of the invention, second oxygen enriched stream 22 is injected into central duct 202. According to embodiments of the invention, as shown in block 403, method 400 includes mixing second oxygen enriched stream 22 with second air stream 24 to form third combustion gas stream 25. Third combustion gas stream 25 may include 21.5 to 27 vol. % oxygen. Blocks 402 and 403 may be conducted simultaneously in central duct 202. At block 403, a volumetric flow rate ratio of second oxygen enriched stream 22 to second air stream 24 may be in a range of 0.3 to 0.65.

According to embodiments of the invention, as shown in block 404, method 400 comprises combusting, in second heating device 201, a fuel in third combustion gas stream 25 to produce heat. In embodiments of the invention, exemplary fuels can include natural gas, $H_2$, $CH_4$, ethane, propane, or combinations thereof. In embodiments of the invention, method 400 is conducted without re-circulated flue gas. In embodiments of the invention, second heating device 201 is operated with forced draft or balanced draft. In embodiments of the invention, method 300 and/or method 400 can be conducted by injecting oxygen enriched air in a central location or a central equipment connected to a heating device.

Although embodiments of the present invention have been described with reference to blocks of FIGS. 2A and 2B, it should be appreciated that operation of the present invention is not limited to the particular blocks and/or the particular order of the blocks illustrated in FIGS. 2A and 2B. Accordingly, embodiments of the invention may provide functionality as described herein using various blocks in a sequence different than that of FIGS. 2A and 2B.

The systems and processes described herein can also include various equipment that is not shown and is known to one of skill in the art of chemical processing. For example, some controllers, piping, computers, valves, pumps, heaters, thermocouples, pressure indicators, mixers, heat exchangers, and the like may not be shown.

Although embodiments of the present application and their advantages have been described in detail, it should be understood that various changes, substitutions and alterations can be made herein without departing from the spirit and scope of the embodiments as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the above disclosure, processes, machines, manufacture, compositions of matter, means, methods, or steps, presently existing or later to be developed that perform substantially the same function or achieve substantially the same result as the corresponding embodiments described herein may be utilized. Accordingly, the appended claims are intended to include within their scope such processes, machines, manufacture, compositions of matter, means, methods, or steps.

What is claimed is:

1. A method of operating a heating device, the method comprising:

flowing a first air stream through one or more oxygen separation membrane modules disposed at a first inlet of the heating device to produce an oxygen enriched stream;

flowing an additional air stream through a first inlet of the heating device such that the additional air stream and the oxygen stream form a first combustion gas stream;

flowing a second air stream and the oxygen enriched stream into the heating device counter-currently to each other such that countercurrent sweep of air across a permeate side of the oxygen separation membrane modules is generated;

mixing the second air stream mixes with the first combustion gas stream to produce an oxygen enriched combustion gas stream; and combusting a fuel in the oxygen enriched combustion gas stream in the heating device to produce heat.

2. The method of claim 1, wherein the fuel includes $CH_4$, $H_2$, propane, ethane, or combinations thereof.

3. The method of claim 1, wherein the countercurrent sweep is configured to reduce energy consumption for separating oxygen.

4. The method of claim 3, wherein the fuel includes $CH_4$, $H_2$, propane, ethane, or combinations thereof.

5. The method of claim 1, wherein the oxygen enriched combustion gas stream comprises 21.5 to 27 vol. % $O_2$.

6. The method of claim 5, wherein the fuel includes $CH_4$, $H_2$, propane, ethane, or combinations thereof.

7. The method of claim 1, wherein the countercurrent sweep is configured to reduce energy consumption for separating oxygen.

8. The method of claim 7, wherein the fuel includes $CH_4$, $H_2$, propane, ethane, or combinations thereof.

* * * * *